US007614162B2

(12) United States Patent
Renzo

(10) Patent No.: US 7,614,162 B2
(45) Date of Patent: Nov. 10, 2009

(54) CLOTHES DRYER REVERSIBLE DOOR ASSEMBLY

(75) Inventor: Pasquale Antonio Renzo, Anjou (CA)

(73) Assignee: Mabe Canada Inc., Burlington (CA)

( * ) Notice: Subject to any disclaimer, the term of this patent is extended or adjusted under 35 U.S.C. 154(b) by 539 days.

(21) Appl. No.: 11/431,049

(22) Filed: May 10, 2006

(65) Prior Publication Data

US 2006/0265959 A1 Nov. 30, 2006

(30) Foreign Application Priority Data

May 30, 2005 (CA) ..... 2508860

(51) Int. Cl.
*F26B 11/02* (2006.01)

(52) U.S. Cl. ..... 34/603; 34/595; 34/601; 49/381; 49/382; 49/463; 49/465

(58) Field of Classification Search ..... 49/381, 49/382, 371, 463, 465, 398; 34/260, 261, 34/264, 318, 417, 425, 499, 540, 63, 108, 34/634, 603, 139, 201, 196, 200, 601, 602, 34/605, 606, 610, 595; 68/139
See application file for complete search history.

(56) References Cited

U.S. PATENT DOCUMENTS 2,262,186 A 11/1941 Lindberg
2,315,354 A 3/1943 Shanman
2,417,998 A * 3/1947 Wales ..... 68/12.22
2,434,886 A 1/1948 Pugh
2,498,181 A 2/1950 Reiter
2,600,210 A 6/1952 Constantine
2,608,003 A 8/1952 Tucker
2,635,354 A 4/1953 Geldhof et al.
2,681,513 A 6/1954 Fowler
2,688,197 A 9/1954 Kercheval
2,707,837 A 5/1955 Paulsen et al.
2,718,711 A 9/1955 Clark
2,728,481 A 12/1955 Robinson et al.
2,792,640 A 5/1957 Patterson (Continued)

FOREIGN PATENT DOCUMENTS

CA 2091941 9/1994

(Continued)

OTHER PUBLICATIONS

Notice of Allowance and Fees Due, Dated May 14, 2009, on related U.S. Appl. No. 11/430,934, filed May 10, 2006.

*Primary Examiner*—Kenneth B Rinehart
*Assistant Examiner*—Corey Hall

(57) ABSTRACT

A clothes dryer door assembly with a viewing window is adapted to be reversibly mounted to a clothes dryer cabinet and has an inner door assembly supporting an inner window and an outer door assembly supporting an outer window. The inner door assembly removably carries a hinge and the outer door assembly is removably secured with the inner door assembly. In order to reverse the door, the outer door assembly is removed from the inner door assembly and rotated 180 degrees. The hinge is removed from the inner door assembly and re-positioned 180 degrees on the inner door assembly. The outer door assembly is then reattached to the inner door assembly. This reversing of the door assembly of the present invention does not require complete disassembly of either of the inner or outer door assemblies.

24 Claims, 8 Drawing Sheets

U.S. PATENT DOCUMENTS

| | | | | |
|---|---|---|---|---|
| 2,827,276 | A | | 3/1958 | Racheter |
| 2,927,380 | A | | 3/1960 | Olthuis |
| 2,983,050 | A | | 5/1961 | Alaback |
| 2,985,966 | A | | 5/1961 | Martin |
| 3,010,217 | A | | 11/1961 | Fuhring |
| 3,040,440 | A | | 6/1962 | Mellinger et al. |
| 3,061,942 | A | | 11/1962 | Scofield |
| 3,067,986 | A | | 12/1962 | Grantham |
| 3,100,978 | A | | 8/1963 | Howlett |
| 3,242,589 | A | | 3/1966 | Jacobs |
| 3,263,343 | A | | 8/1966 | Loos |
| 3,276,229 | A | | 10/1966 | Deiss |
| 3,854,219 | A | | 12/1974 | Staats |
| 3,959,891 | A | | 6/1976 | Burkall |
| 4,112,590 | A | | 9/1978 | Muller |
| 4,516,331 | A | | 5/1985 | Yamauchi et al. |
| 4,522,311 | A | | 6/1985 | Ikeda |
| 4,615,125 | A | | 10/1986 | Wyborn |
| 4,669,199 | A | | 6/1987 | Clawson et al. |
| 4,753,018 | A | | 6/1988 | Golichowski |
| 4,934,559 | A | | 6/1990 | Putnam |
| 5,113,562 | A | * | 5/1992 | Studt ..... 29/401.1 |
| 5,195,647 | A | | 3/1993 | Studt |
| 5,459,945 | A | | 10/1995 | Shulenberger |
| 5,651,188 | A | | 7/1997 | Swanson et al. |
| 5,651,192 | A | | 7/1997 | Horwitz |
| 5,664,339 | A | | 9/1997 | Swanson et al. |
| 5,664,340 | A | | 9/1997 | Brown |
| 5,940,988 | A | | 8/1999 | Eisen |
| 5,953,831 | A | | 9/1999 | Yu |
| 6,088,932 | A | | 7/2000 | Adamski et al. |
| 6,135,130 | A | | 10/2000 | Martineau |
| 6,195,910 | B1 | | 3/2001 | Robineau |
| 6,223,452 | B1 | | 5/2001 | Hamand |
| 6,381,874 | B1 | | 5/2002 | Floyd |
| 6,732,447 | B2 | | 5/2004 | Tomasi et al. |
| 6,761,049 | B2 | | 7/2004 | Nitschmann et al. |
| 6,766,596 | B1 | | 7/2004 | Bienick et al. |
| 6,862,903 | B2 | | 3/2005 | Nitschmann et al. |
| 6,877,248 | B1 | | 4/2005 | Cross et al. |
| 6,910,286 | B2 | | 6/2005 | Hwang |
| 6,931,761 | B2 | | 8/2005 | Hwang |
| 7,024,801 | B2 | | 4/2006 | Hwang |
| 7,191,548 | B2 | | 3/2007 | Salameh et al. |
| 7,299,666 | B2 | | 11/2007 | Geyer et al. |
| 7,320,186 | B2 | | 1/2008 | Schone |
| 7,325,330 | B2 | | 2/2008 | Kim et al. |
| 7,363,781 | B2 | | 4/2008 | Erickson |
| 2003/0046964 | A1 | | 3/2003 | Bollmann |
| 2003/0115915 | A1 | | 6/2003 | Nitschmann et al. |
| 2003/0172689 | A1 | | 9/2003 | Fitton et al. |
| 2004/0020246 | A1 | * | 2/2004 | Yun et al. ..... 68/24 |
| 2004/0050117 | A1 | | 3/2004 | Geyer et al. |
| 2004/0123489 | A1 | | 7/2004 | Pancheri et al. |
| 2004/0123490 | A1 | | 7/2004 | Pancheri et al. |
| 2004/0159009 | A1 | | 8/2004 | Hwang |
| 2004/0159010 | A1 | | 8/2004 | Hwang |
| 2004/0163275 | A1 | | 8/2004 | Hwang |
| 2005/0034486 | A1 | * | 2/2005 | Bienick et al. ..... 68/3 R |
| 2005/0076532 | A1 | | 4/2005 | Ward et al. |
| 2005/0086831 | A1 | | 4/2005 | Ryu |
| 2005/0235519 | A1 | | 10/2005 | Chung |
| 2006/0117596 | A1 | | 6/2006 | Kim et al. |
| 2006/0123855 | A1 | * | 6/2006 | Erickson ..... 68/24 |
| 2006/0265899 | A1 | | 11/2006 | Renzo |
| 2007/0051012 | A1 | | 3/2007 | Schoene |
| 2007/0113421 | A1 | | 5/2007 | Uhara et al. |
| 2007/0130790 | A1 | | 6/2007 | Jung |
| 2007/0180728 | A1 | | 8/2007 | Kim et al. |
| 2007/0227035 | A1 | | 10/2007 | Leroy |
| 2009/0056161 | A1 | | 3/2009 | Ahn et al. |
| 2009/0064534 | A1 | | 3/2009 | LeClerc |
| 2009/0083991 | A1 | | 4/2009 | Prajescu |
| 2009/0083992 | A1 | | 4/2009 | Prajescu et al. |

FOREIGN PATENT DOCUMENTS

| | | | |
|---|---|---|---|
| DE | 195 15 040 | C2 | 9/1999 |
| EP | 0 293 984 | B1 | 12/1991 |
| GB | 2 1 18 580 | A | 11/1983 |
| KR | 20030038735 | * | 5/2003 |
| KR | 20040006241 | * | 1/2004 |
| KR | 20040011218 | * | 2/2004 |

* cited by examiner

CLOTHES DRYER REVERSIBLE DOOR ASSEMBLY

RELATED APPLICATION

The present application is related to Applicants commonly assigned U.S. patent application Ser. No. 11/430,934 filed concurrently herewith and entitled Clothes Dryer Door Assembly.

FIELD OF THE INVENTION

The present invention relates to clothes dryers, and more particularly relates to a clothes dryer door assembly with a viewing window that is adapted to be reversibly mounted to a clothes dryer cabinet.

BACKGROUND OF THE INVENTION

A domestic clothes dryer typically has a cabinet including a front panel with an access opening through which clothes are loaded and unloaded into a rotating drum. The door is mounted through one or more hinges to the cabinet front panel on one side of the access opening.

Typically, these doors are manufactured to open by pivoting out to the right or the left. While it is possible to order the door to pivot out in the direction required for the user, should the need arise by the user changing living space or laundry space in the home, it may be necessary to reverse the door and change the side to which the door pivots open. For example, the location of the washing machine relative to the dryer is fixed by pre-existing plumbing and/or dryer vent holes and this may require changing the pivot direction the door opens to facilitate transfer of clothing from the washing machine to the clothes dryer. Thus, it would be desirable to have a window dryer door that could be reversed so that it could readily be hung or mounted from either side of the access opening depending on the requirements of the particular installation. Further, it may be desirable for a manufacturer to be able to easily reverse the mounting side of the door.

For a door having a viewing window, many of these doors are port hole type doors and the clothes dryer typically has a front panel with a circular opening and a circular door jam. The dryer drum bulkhead is mounted in the dryer adjacent the panel and has a circular opening that is cropped horizontally along the bottom of the opening permitting the dryer bulkhead to provide a trap duct for receiving a filter through which air exits the dryer drum. This type of dryer construction results in the window door typically comprising an outer circular window of plastic and an inner glass window that is non-circular and is cropped to conform to the opening in the bulkhead of the dryer. Reversing the hinge for this type of dryer door involves the disassembly of the door, reversing of the hinge and then re-assembly of the complete door.

Clearly, there is a need for an improved window type dryer door that may be converted to open from an opposite side of the dryer that does not involve the complete disassembly of the door.

BRIEF DESCRIPTION OF THE INVENTION

The present invention relates to a clothes dryer door assembly with a viewing window that is adapted to be reversibly mounted to a clothes dryer cabinet. The door assembly comprises an inner door assembly supporting an inner window and an outer door assembly supporting an outer window. The inner door assembly removably carries a hinge and the outer door assembly is removably secured with the inner door assembly. In order to reverse the door, the outer door assembly is removed from the inner door assembly. The hinge is removed from the inner door assembly and re-positioned 180 degrees on the inner door assembly. The outer door assembly is then rotated 180 degrees and reattached to the inner door assembly. The reversing of the inner door assembly relative to the outer door assembly of the present invention does not require disassembly of either the inner and outer door assemblies.

In accordance with a method of the present invention, the door assembly may be reversibly mounted to a clothes dryer cabinet by the steps of:

removing the door assembly at the hinge from the clothes dryer cabinet, removing the outer door assembly from the inner door assembly, removing the hinge from the inner door assembly and re-securing the hinge on the inner door assembly rotated 180 degrees from an initial position, re-attaching the outer door assembly to the inner door assembly; and, re-attaching the door assembly at the hinge to the clothes dryer cabinet.

In an embodiment of the door assembly where the outer door assembly comprises a handle mounted to one side of the door, the method of the invention further comprises, prior to the step of re-attaching the outer door assembly, the step of rotating the outer door assembly relative to the inner door assembly to rotate the handle to another side of the door. The rotation of the outer door assembly to the inner door assembly may be a 180 degrees rotation.

In an embodiment of the door assembly where the inner door assembly further removably carries a retainer disposed 180 degrees from the hinge, the method further comprises, prior to re-attaching the outer door assembly to the inner door assembly, the step of removing the retainer from the inner door assembly and re-securing the retainer on the inner door assembly rotated 180 degrees from an initial position.

In one embodiment of the invention there is provided a door assembly adapted to be mounted in alternate positions on the front panel of a clothes dryer cabinet so that the door assembly can be configured to be opened from either left or right side. The door assembly comprises an inner door assembly. The Inner door assembly comprises an inner door frame support for supporting an inner window, a mask frame secured to the inner door support frame for masking the inner door frame, and a hinge structure removably secured in one of two first positions to the inner door frame support. The door assembly comprises an outer door assembly removably secured in one of two second positions to the inner door assembly. The outer door assembly comprises an outer window secured to an outer peripheral cover. The cover covers the hinge structure, the mask frame and the inner door frame support when the outer door assembly is secured to the inner door assembly.

In one embodiment of the invention there is provided a door assembly adapted to be mounted in alternate positions on the front panel of a clothes dryer cabinet so that the door assembly can be configured to be opened from either left or right side. The door assembly comprises an inner door assembly and an outer door assembly removably secured in one of alternate positions to the inner door assembly. The inner door assembly comprises an inner door frame support having a first peripheral flange having two horizontally disposed hinge seat portions. The inner door frame support has a recessed window seat portion surrounding a first central opening defined by the inner door frame support. The inner door assembly comprises an inner window seated in the window seat portion across the first central opening, a mask frame secured to the inner door frame support for masking the inner door support and for securing the inner window in the recessed window seat portion. A hinge structure is removably secured in one of the horizontally disposed hinge seat portions and comprises a hinge element extending from the inner door assembly. The outer door assembly comprises an outer window attached to an outer cover. The cover comprises a second central opening and a second peripheral flange adapted to cover the hinge structure, the mask frame and the first peripheral flange of the inner door frame support. The second window extends across the second central opening of the cover.

BRIEF DESCRIPTION OF THE DRAWINGS

For a better understanding of the nature and objects of the present invention reference may be had by way of example to the accompanying diagrammatic drawings.

DETAILED DESCRIPTION OF THE INVENTION

Figure 1:
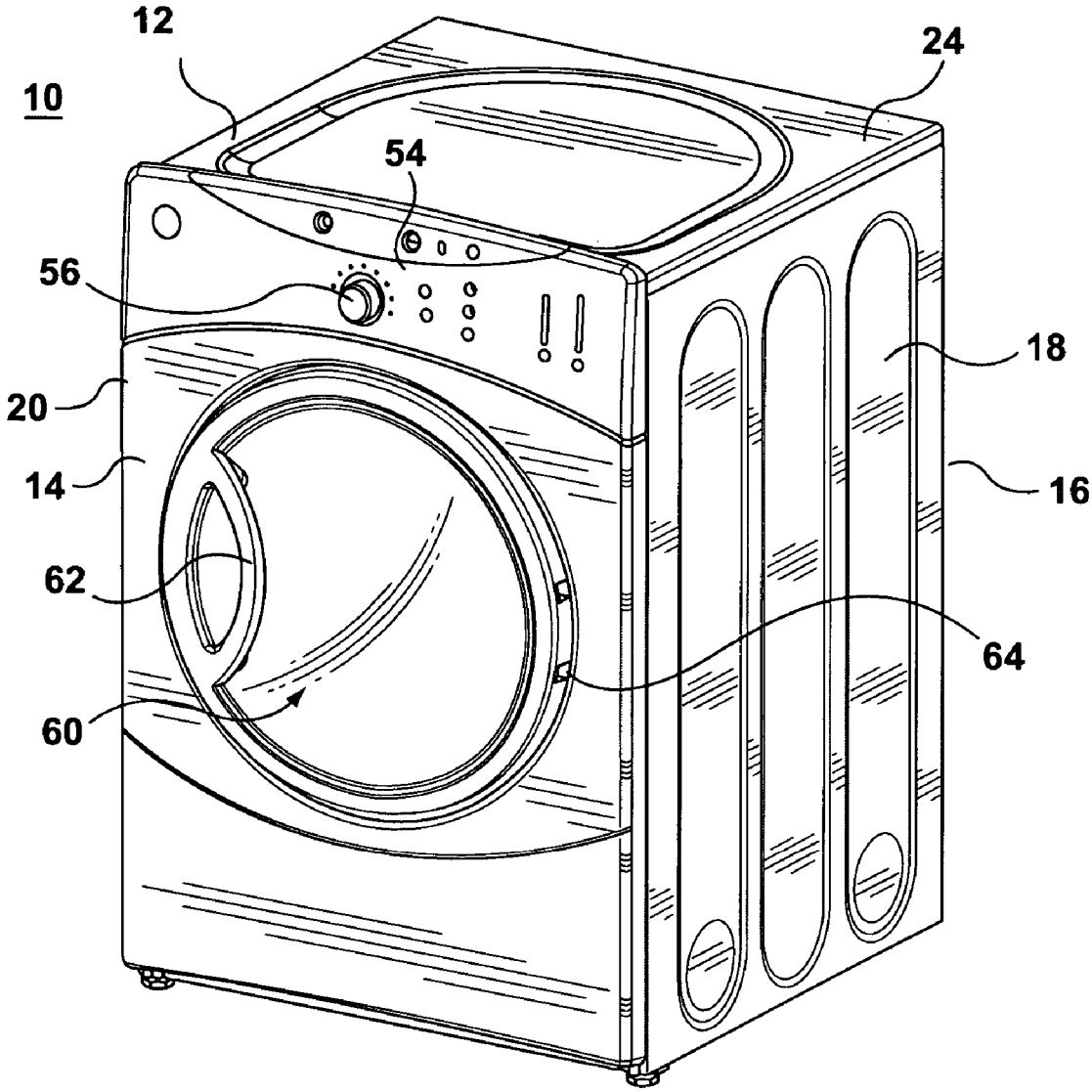
FIG. 1 is a perspective view of an exemplary clothes dryer that may benefit from the present invention.
Figure 2:
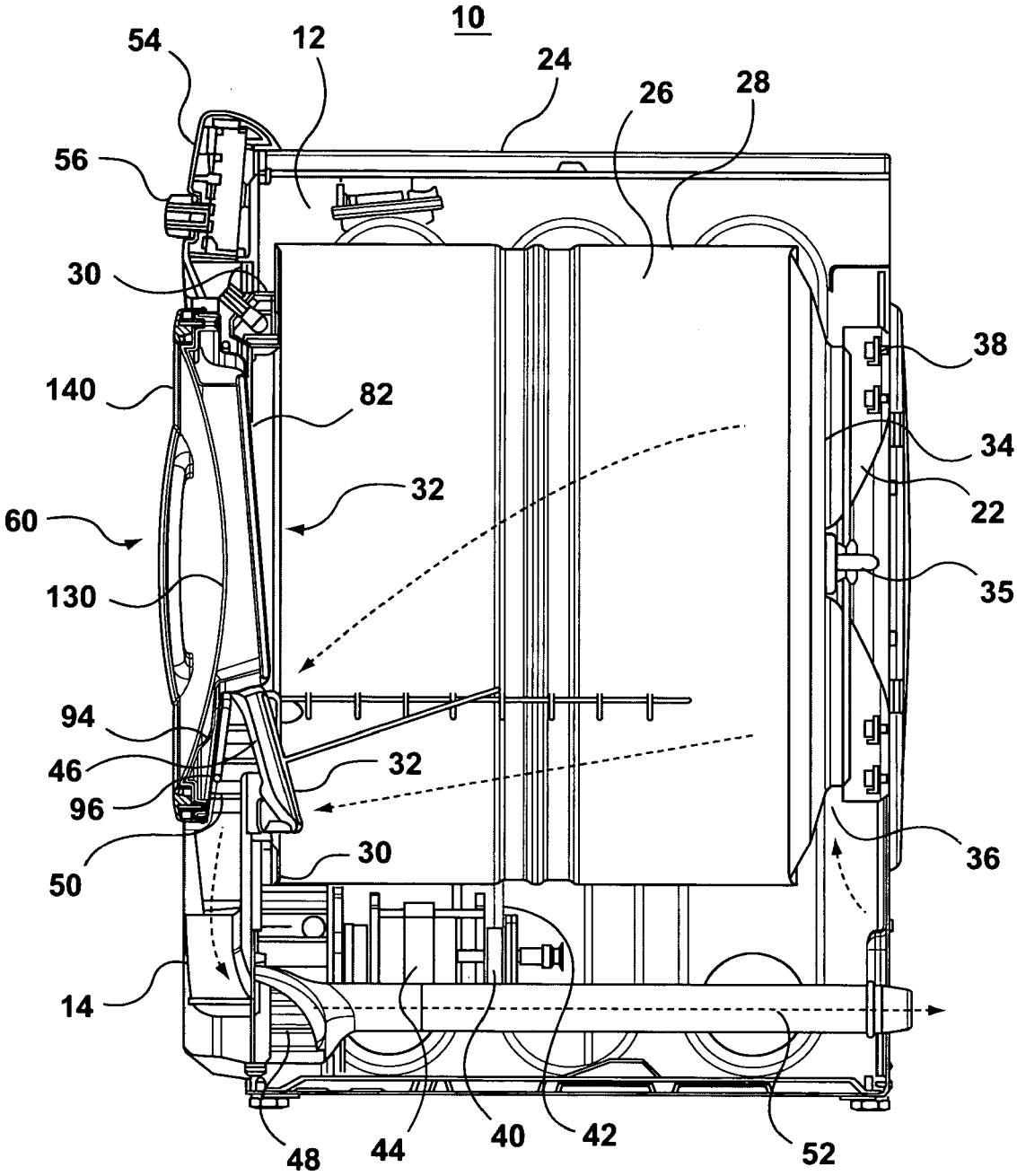
FIG. 2 is a side sectional view of an exemplary clothes dryer that may benefit from the present invention.

FIGS. 1 and 2 show perspective and side sectional views of an exemplary clothes dryer 10 that may benefit from the present invention. The clothes dryer includes a cabinet or a main housing 12 having a front panel 14, a rear panel 16, a pair of side panels 18 and 20 spaced apart from each other by the front and rear panels, and a top cover 24. Within the housing 12 is a drum or container 26 mounted for rotation around a substantially horizontal axis. A motor 44 rotates the drum 26 about the horizontal axis through, for example, a pulley 40 and a belt 42. The drum 26 is generally cylindrical in shape, has an imperforate outer cylindrical wall 28, and is closed at its front by a bulkhead wall or bearing 30 defining an opening 32 into the drum 26. Clothing articles and other fabrics are loaded into the drum 26 through the opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by a suitable fixed bearing 35. The rear wall 34 includes a plurality of holes (not shown) that receive hot air that has been heated by a heater such as electrical heating elements 38 in the heater housing 22. The housing 22 receives ambient air via an inlet 36. Although the exemplary clothes dryer 10 shown in FIG. 1 is an electric dryer, it could just as well be a gas dryer having a gas burner. The heated air is drawn from the drum 26 by a blower fan 48 which is also driven by the motor 44. The air passes through a screen filter 46 which traps any lint particles. As the air passes through the screen filter 46, it enters a trap duct 50 and is passed out of the clothes dryer through an exhaust duct 52. After the clothing articles have been dried, they are removed from the drum 26 via the opening 32. The dryer has a control panel 54 with touch and or dial controls 56 whereby a user can control the operation of the dryer.

Clothes are inserted into, and removed from, the drum 26 through opening 32. Opening 32 is shown closed by a window or port-hole like door 60. Door 60 has a handle 62 for pivotally opening the door about hinge 64.

Figure 3:
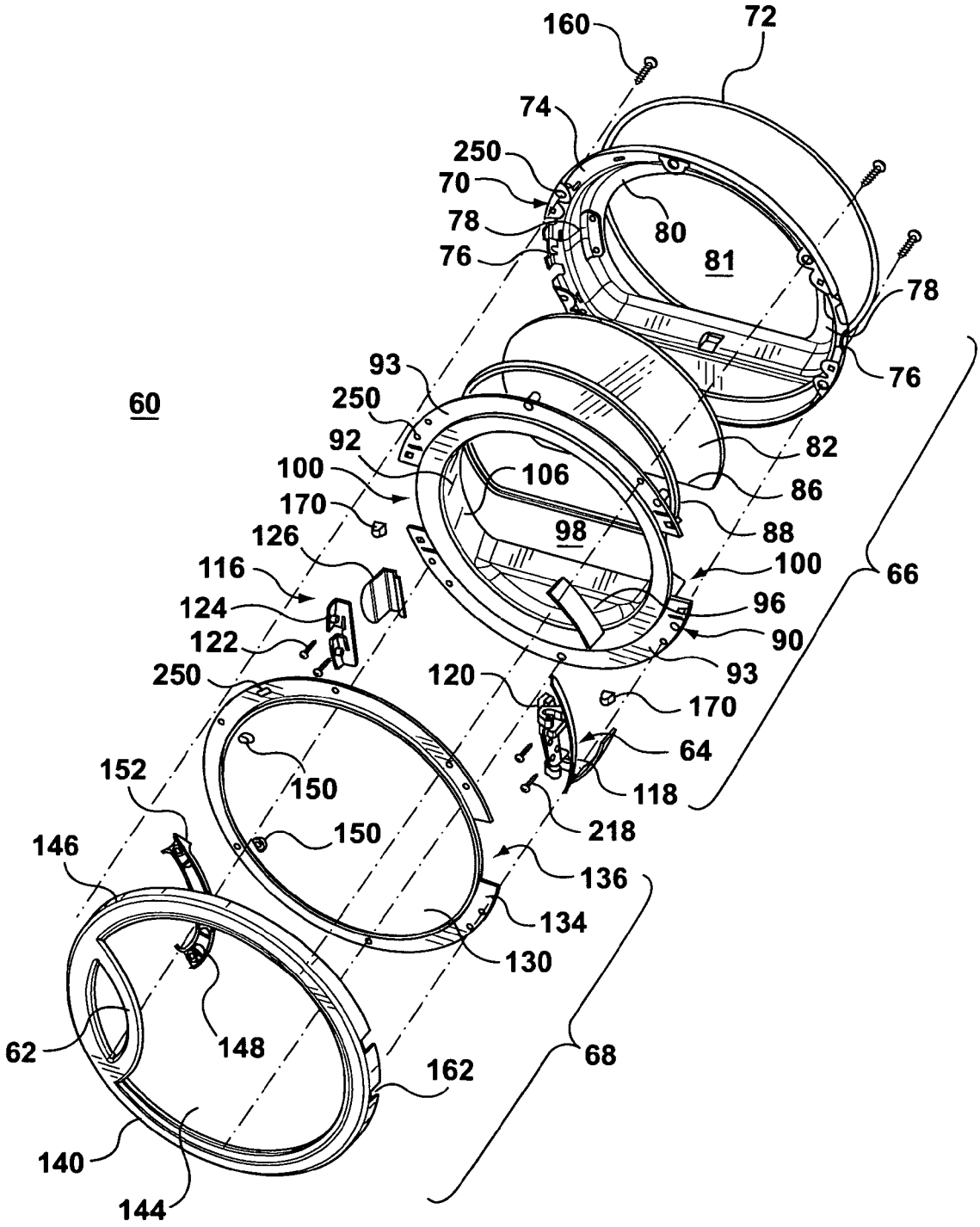
FIG. 3 is an exploded view of the clothes dryer door assembly of the present invention.

In accordance with the present invention, the assembly of the door 60 is now described with respect to FIGS. 3 through 9. The door assembly 60 includes four peripheral flanges 74, 142, 134 and 93. The first peripheral flange is peripheral flange 74. The second peripheral flange is peripheral flange 142. The third peripheral flange is peripheral ring-like flange 134. The fourth peripheral flange includes two arcuate peripheral flanges 93. In FIG. 3, the door assembly 60 is shown to comprise an inner door assembly 66 and an outer door assembly 68. The inner door assembly 66 comprises an inner door frame support 70. The inner door frame support is made from a steel or stainless steel material. The inner door frame support 70 is shown in perspective view in FIG. 9 with the inner window 82. Backed onto the inner door frame support 70 is a gasket 72 which forms a seal with a clothes dryer cabinet 12 when the door 60 is closed. The inner door frame support 70 comprises first peripheral flange 74 that has two horizontally disposed or alternate hinge seat portions 76. The peripheral flange 74 comprises a circular flange that has a first collar 78 depending rearwardly therefrom. The collar 78 defines a recessed window seat portion 80 in the form of a lip portion. The recessed seat portion 80 surrounds a first central opening 81 in the inner door frame support 70.

The inner door assembly 66 further comprises an inner window 82. The inner window 82 comprises a flat glass piece which is circular in shape and has a truncated or cropped lower edge portion 86. In alternative embodiments, the glass may be a molded glass. The peripheral edge of the glass is surrounded by a gasket 88. The window 82 is adapted to be seated within the recessed seat portion 80 of the inner door frame support 70 so as to extend across the first central opening 81.

The inner door assembly 66 further comprises a mask frame 90 that is secured with the inner door frame support 70 to secure the window 82 in place in the window seat portion 80. The mask frame 90 is illustrated as a separate part in FIG. 7 and has a collar 92 that depends rearwardly from the two arcuate peripheral flanges 93. The arcuate flanges 93 are adapted to overlay the peripheral flange 74 of the inner door frame support 70 and the mask collar 92 is adapted to overlay the collar 78 of the inner door frame support 70. The purpose of the mask frame 90 is two fold. Its first purpose is to mask from view the structure of the inner door frame support 70. The mask frame 90 has a lower portion 94 that also masks from view the lower portion 96 of the inner door frame support 70. It should be understood that the lower portion 94 of the inner door support frame 70 below collar 78 overlays the lint filter trap 50 between the front panel 14 and the bulk head wall 30 of the dryer when door 60 is closed (see FIG. 2). The second purpose of the mask frame 90 is to hold the window 62 in place in the recessed seat portion 80.

Figure 6:
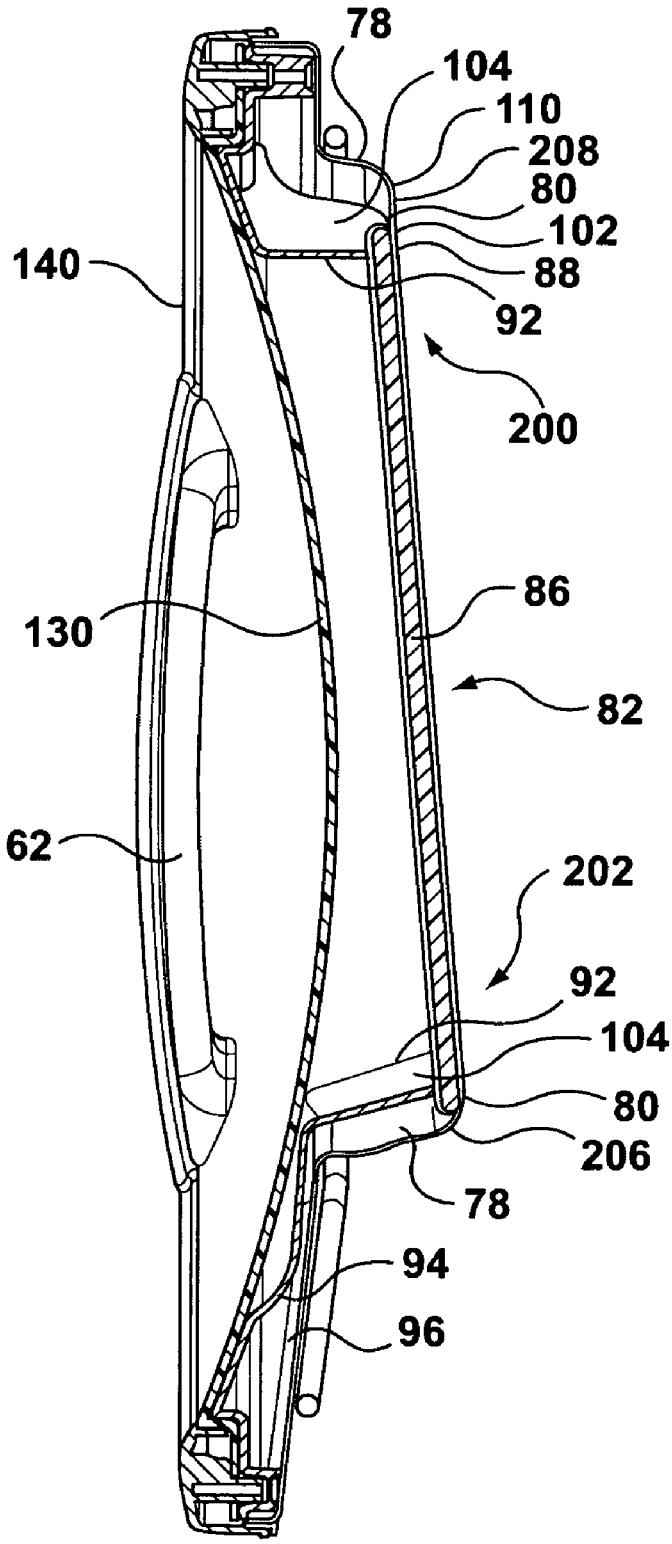
FIG. 6 is a sectional view of the door assembly taken through lines VI-VI of FIG. 4.

The mask frame 90 defines a second central opening 98. The mask frame 90 has two cut out slots 100 between the flanges 93. These cut out slots 100 are positioned adjacent to the horizontally disposed hinged seat portions 76 when the inner door assembly 66 is assembled. From FIG. 7, it can be seen that the collar 92 of mask frame 90 extends rearwardly from the peripheral flanges 93. The collar 92 comprises an inner surface 106 and an outer surface 108. The outer surface 108 is positioned to face towards the first collar 78 of the inner door frame support 70. The mask frame 90 further comprises rearwardly extending rib spacers 104 that are attached to the outer surface 108 of the collar 92. These spacers 104 have a tip 110 with a cut out section 102. The tip 110 together with the cut out section 102 of the ribs 104 act to secure the inner window 82 within the recessed seat portion 80 of the inner door frame support 70 when the mask frame 90 is secured to the inner door frame support 70. In FIG. 6, it can also be seen that the spacer or ribs 104 have a tip portion 110 with its cut out slot 102 that surrounds and engages the gasket 88 of the inner window 82.

Figure 7:
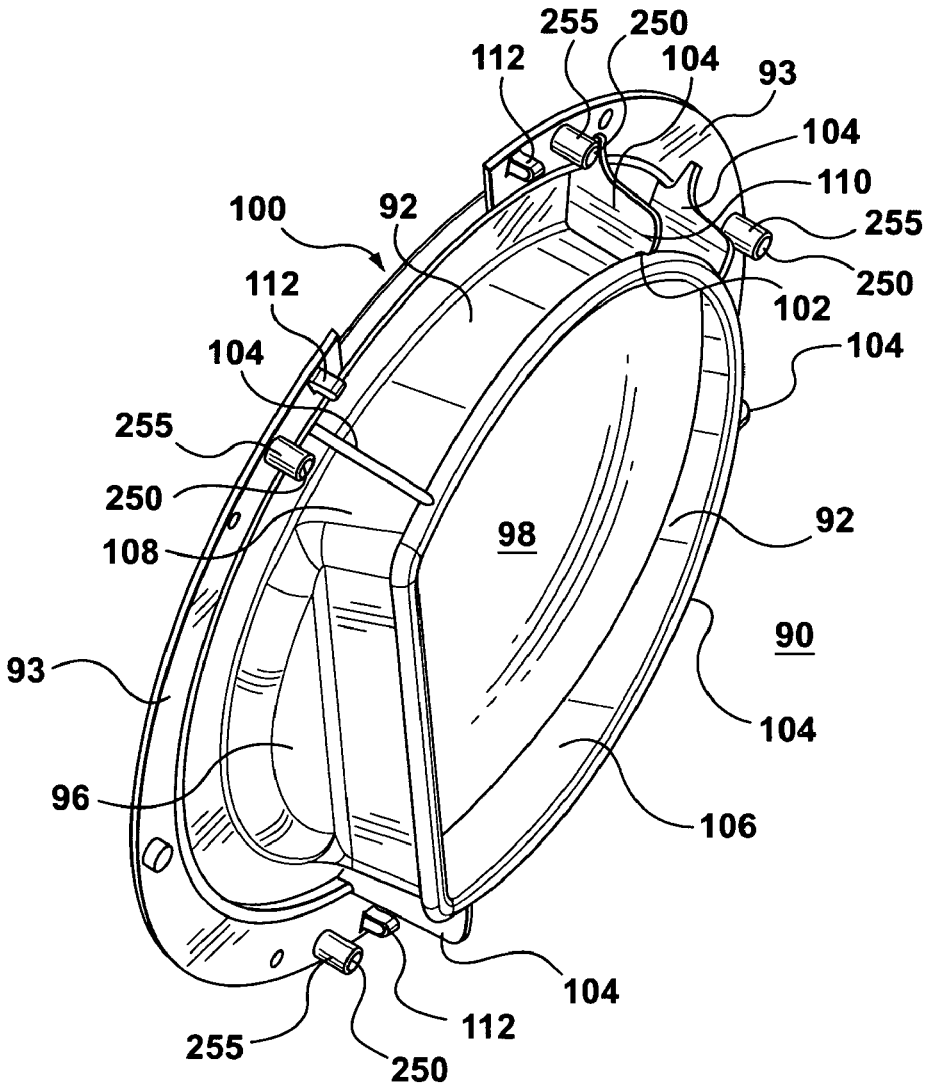
FIG. 7 is a rear perspective view of the mask frame of the door assembly.
Figure 8:
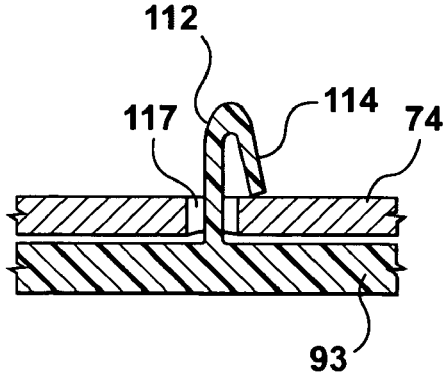
FIG. 8 is an enlarged view showing the connection made by the barb-like connectors of the present invention; and, FIG. 9 is an inside perspective view of the inner door frame support, inner window, the hinge and retainer.

Referring to FIG. 7, the peripheral flanges 93 of the mask frame 90 each comprise a plurality of barb like connectors 112. As better seen in FIG. 8, the barb like connector 112 has a hook portion 114 that passes through an opening 117 in the first peripheral flange 74 of the inner door frame support 70. As the barb connector 112 passes through opening 117, the hook portion 114 is compressed and then springs open to lock the peripheral flanges 93 relative to the peripheral flange 74. In this way the barb connectors 112 in co-operation with the openings 117 act to assemble the mask frame 90 relative to the inner door frame support 70 with the window 82 sandwiched between the mask frame 90 and the inner door support frame 70. As shown in FIG. 7, the rear face of the flanges 93 have spacers 255 with pass through apertures 250. Spacers 255 together with barb connectors 112 maintain the relative positioning of the mask frame 90 and the inner door frame support 70. Hence the connectors 112 and the openings 117 co-operate to assemble the inner door assembly 66 without the use of any fasteners.

Referring to FIG. 6 the distance the recesses of the collars 78 and 92 rearwardly extend is greater at the lower portion 202 of the door than at the upper portion 200 of the door. This results in the recessed window seat portion 80 sloping downwardly and rearwardly to present a lower seat portion 206 thereof that is more recessed than the upper seat portion 208. As a result the inner window 82 seated in the recessed seat portion 80 slopes downwardly and rearwardly towards the interior of the dryer cabinet. The lower seat portion 80 extends over the lint trap 46 (as best seen in FIG. 2). This results in a door effectively covering the opening for the filter 46 in the trap duct 50 while at the same time optimizing volume within the dryer drum.

Figure 5:
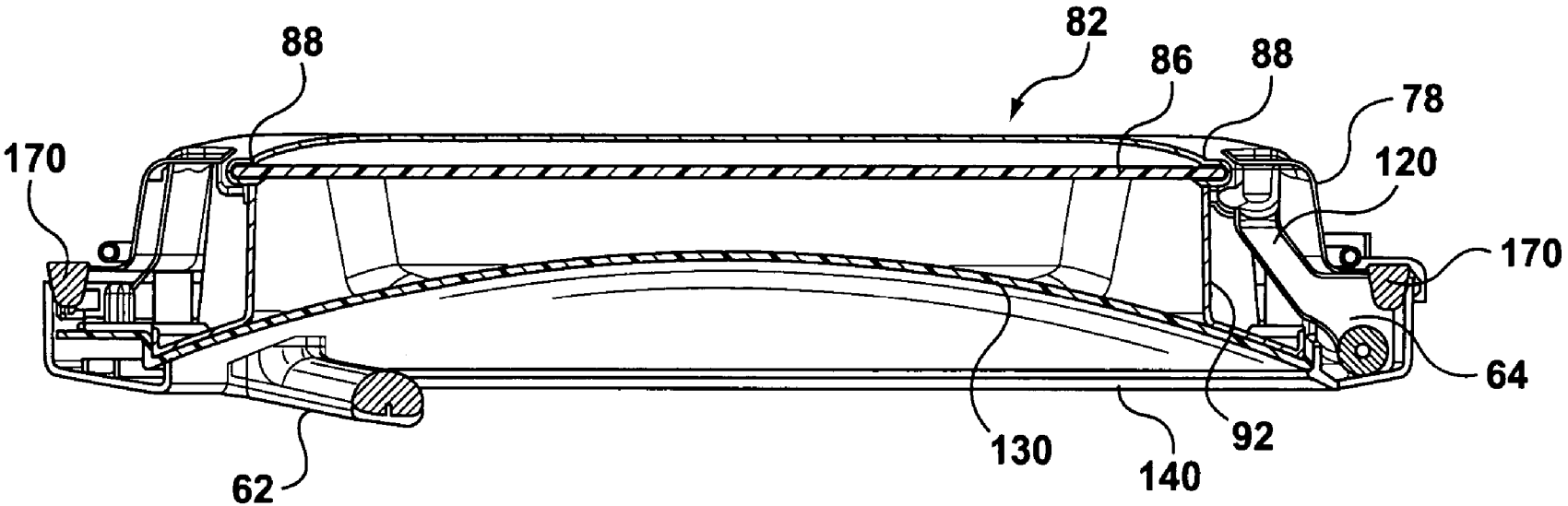
FIG. 5 is a sectional view of the door assembly taken through lines V-V of FIG. 4.
Figure 9:
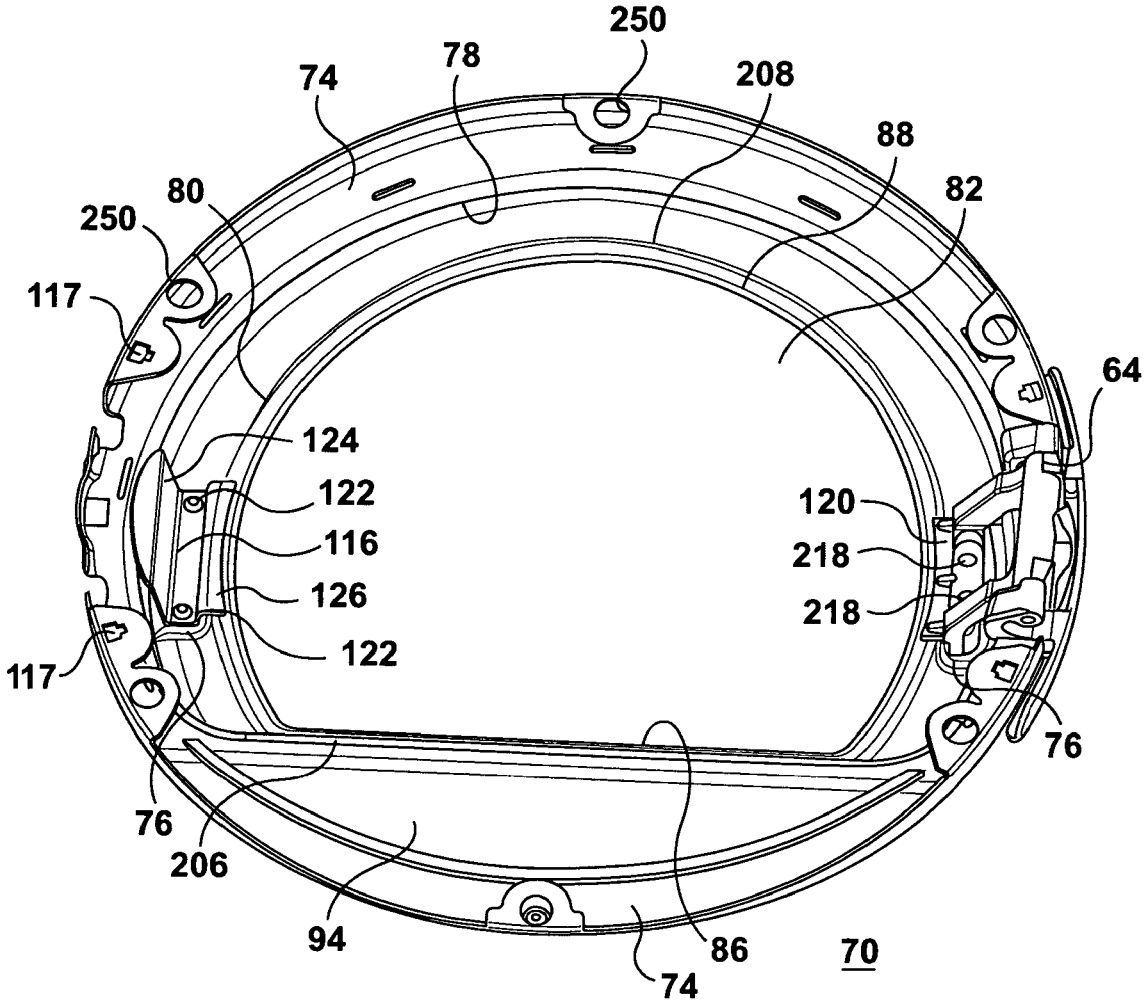

Referring to FIGS. 3, 5, and 9, the inner door assembly 66 further comprises hinge 64 and retainer 116. The hinge structure 64 is secured to the inner door frame support 70 by fasteners 218 that pass through openings in the hinge structure 64 and into corresponding openings in the seat portions 76 of the inner door support frame 70. The hinge structure 64 is secured in one of the horizontally disposed hinged seat portions 76 of the inner door frame support 70. The hinge structure 64 has a first hinge element 118 (FIG. 3) that extends from the inner door assembly 66 for securement with the front panel 14 and/or bulk head 30 of the dryer adjacent the opening 32. As shown in FIGS. 5 and 9, the hinge structure 64 has a second hinge element 120 that is adapted to engage the inner window 82 at the gasket 88 to secure the window 82 in the recessed seat portion 80. The hinge element 120 of the hinge structure 64 extends rearwardly between the collar 78 of the inner door frame support 70 and collar 92 of the mask frame 90.

In a similar manner the retainer 116 is removably mounted by fasteners 122 in the other one of the horizontally disposed hinged seat portions 76 of the inner door support frame. The retainer 116 comprises a cover 124 and a retainer portion 126. The retainer portion 126 is adapted to engage the gasket 88 of the inner window 82 to positively hold the window 82 in the recessed seat portion 80. In the detailed description the hinge 64, retainer 116 and mask frame 90 act to hold the window 82 in place on the inner door frame support 70. It should be understood that either the mask frame 90 or the hinge 64 and retainer 116 may be used mutually exclusive of each other to secure the window 82 in place on the inner door frame.

Referring to FIG. 3, the door assembly 60 further includes an outer door assembly 68. The outer door assembly 68 comprises an outer window 130. The outer window 130 comprises a concave circular shaped central portion surrounded by peripheral ring like flange 134. The flange 134 extends substantially around the circular concave center portion except for the cut out section 136. Cut out section 136 is located adjacent the hinge element structure 64. The outer window 130 comprises a plastic and preferably comprises a transparent polycarbonate material. The outer door assembly 68 further comprises a cover 140 that has peripheral flange 142 comprising a ring flange with a central opening 144. The cover 140 has a depending rim 146 that depends from its peripheral flange 142. The peripheral flange 142 is further provided with an outer handle portion shown as 62. The outer door assembly 68 further comprises a structural handle portion 148 that is mounted by two fasteners 156 passing through apertures 150 in the outer window 130, apertures 152 in the handle portion 148 and into receiving studs (not shown) in the reverse face of the outer handle portion 62. The fasteners 156 effectively secure the outer window 130 to the cover 140 and thereby complete the assembly of the outer door assembly 68. The outer window 130 provides further structural support for the door assembly 60.

The peripheral ring like flange 134 of the outer window 130 is nested in the ring like peripheral flange 142 and the rim 146 of the cover 140. The flange 134 is substantially coextensive with the peripheral flange 142 of the cover 140 except for the cut out portion 136 that is provided to allow the cover flange 142 to overlay the hinge structure 64.

To complete the assembly of the door 60 the inner door 66 is secured to the outer door 68 by a plurality of fasteners 160 that pass through aligned apertures 250 in the peripheral flange 74 of the inner door frame support 70, the peripheral flanges 93 of the mask frame 90, the peripheral flange 134 of the outer window 130 and into receiving studs (not shown) found on the rear surface of the peripheral flange 142 of the cover member 140.

Additionally latches or spacers 170 (see FIGS. 3 and 5) are provided to mount and orientate the hinge element 164 and the retainer portion 126 and cover 124 in the respective horizontally disposed seat portion 76.

Figure 4:
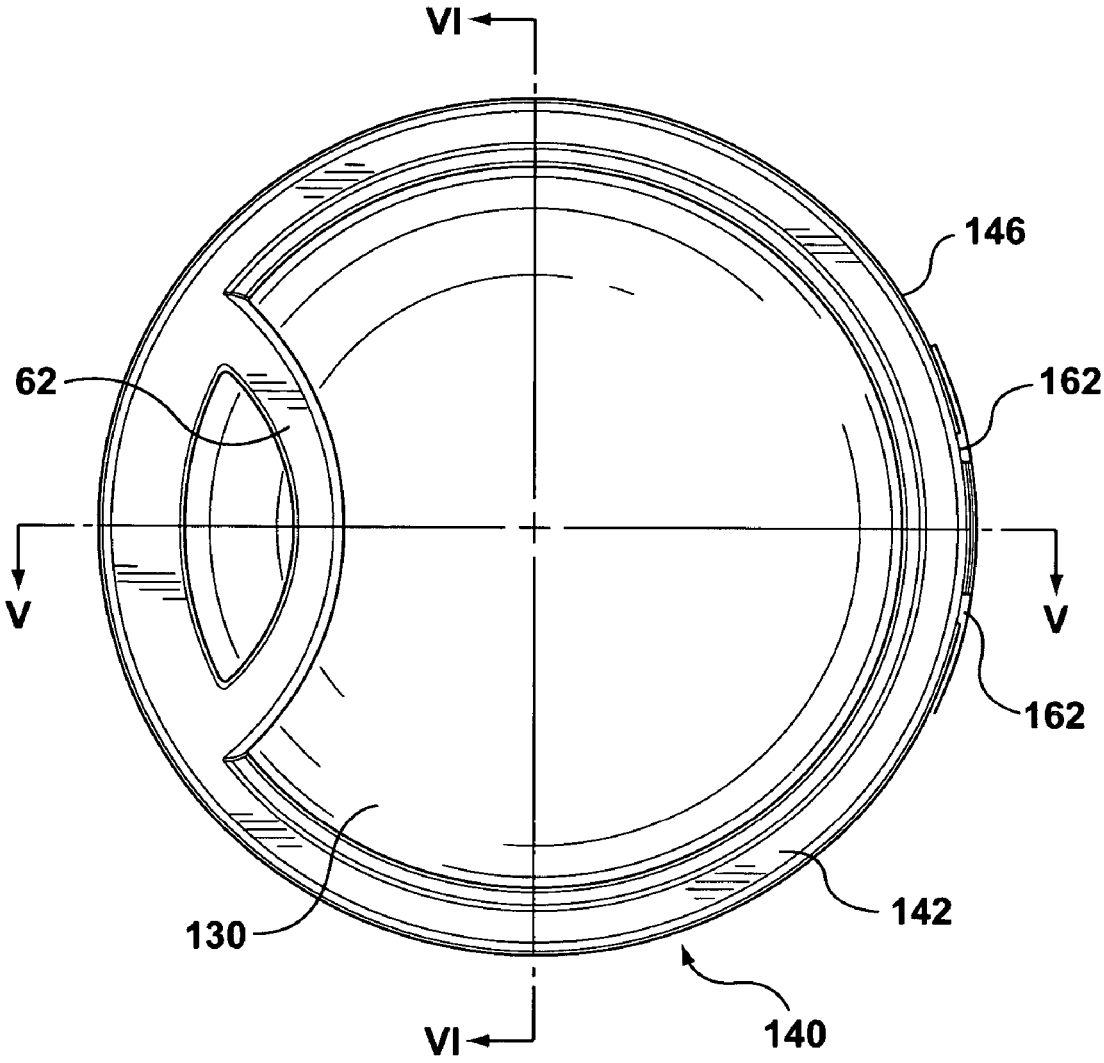
FIG. 4 is a front view of the door assembly of FIG. 3.

Referring to FIG. 4, the front cover 140 covers the appearance of the door such that the central opening 144 of the front cover and the central opening 98 of the mask frame 90 are covered by the concave shaped circular central portion of the outer window 130. Disposed horizontally opposite to the handle 62 on the rim 146 of the cover 140 are two slotted openings 162. Openings 162 permit for the first hinge element 118 to extend from the door assembly 60 for connection with the clothes dryer cabinet.

The construction of the clothes dryer door assembly 60 allows for a the mask frame 90 to be secured to the inner door frame support 70 so as to hold the inner window 82 in place without having to utilize additional fasteners other than the hinge 64 and the retainer 126 to hold the window 82 in place. Further, the door structure of the present invention is adapted for reversibility or for rotation of the outer door assembly 68 relative to the inner door assembly 66.

The door assembly 60 is adapted to be mounted in alternate positions on the front panel 14 of the clothes dryer cabinet 12 so that the door assembly 60 can be configured to open either from the left or ride side. As shown in FIG. 1 the door assembly 60 opens from the left side of the dryer 10. If one were to reverse the opening of the door this can be done by removing the door assembly 60 at the hinge structure 64 from the clothes dryer cabinet 12. Next, the fasteners 160 are removed so that the outer door assembly 68 is removed from the inner door assembly 66. Thereafter the hinge structure 66 and the retainer 116 are removed by removing fasteners 218 and 122. The hinge 64 and the retainer 116 are then rotated 180 degrees from their initial position into the other or alternate horizontally disposed seat portion 76. Then the hinge structure 64 and the spacer 126 are reattached by fasteners 218 and 122. The outer door assembly 68 is then rotated 180 degrees relative to the inner door assembly 66. The fasteners 160 are reinserted to secure the outer door assembly 68 to the inner door assembly 66. This is facilitated by the apertures 250, through which the fasteners 160 pass, being aligned symmetrical to each other about the horizontal axis extending through the door assembly 60. This symmetrical or mirroring arrangement facilitates placement of the outer door assembly 68 relative to the inner door assembly 66 at 180 degrees disposed from its previous position. The hinge structure 64 is then reattached to the dryer housing 12 to complete the reversing of the door relative to the dryer 10. Rotation of the outer door assembly 68 relative to the inner door assembly 66 permits for the dryer to be changed between left and right opening doors without completely disassembling each of the inner door assembly 66 and the outer door assembly 68 while at the same time maintaining the lower portions 94 and 96 of the inner drum support 70 and the mask frame 90 in the same orientation adjacent the lint trap duct 50.

While the invention has been described in terms of various specific embodiments, those skilled in the art will recognize that the invention can be practiced with modifications within the spirit and scope of the present invention disclosed herein.

What is claimed is:

1. A door assembly adapted to be mounted in alternate positions on the front panel of a clothes dryer cabinet so that the door assembly can be configured to be opened from either left or right side, said door assembly comprising:

an inner door assembly comprising an inner door frame support for supporting an inner window, a mask frame secured to the inner door support frame for masking the inner door frame, and a hinge structure removably secured in one of two first positions to the inner door frame support; and, an outer door assembly removably secured in one of two second positions to the inner door assembly, the outer door assembly comprising an outer window secured to an outer peripheral cover, the cover covering the hinge structure, the mask frame and the inner door frame support when the outer door assembly is secured to the inner door assembly.

2. The door assembly of claim 1 wherein the inner window is flat and the mask frame locates the inner window relative to the inner door frame support when the mask frame is secured to the inner door frame support.

3. The door assembly of claim 2 wherein the inner door assembly further comprises a retainer removably secured to the inner door support frame in the other of the two first positions.

4. The door assembly of claim 1 wherein the cover further comprises a handle positioned in horizontal opposing relation to positioning of the hinge structure.

5. A door assembly adapted to be mounted in alternate positions on the front panel of a clothes dryer cabinet so that the door assembly can be configured to be opened from either left or right side, said door assembly comprising:

an inner door assembly and an outer door assembly removably secured in one of alternate positions to the inner door assembly, the inner door assembly comprising an inner door frame support having a first peripheral flange having two horizontally disposed hinge seat portions and the inner door frame support having a recessed window seat portion surrounding a first central opening defined by the inner door frame support, the inner door assembly comprising an inner window seated in the window seat portion across the first central opening, a mask frame secured to the inner door support frame for masking the inner door frame support and for locating the inner window in the recessed window seat portion, a hinge structure removably secured in one of the horizontally disposed hinge seat portions and comprising a hinge element extending from the inner door assembly, and, the outer door assembly comprising an outer window attached to an outer cover, the cover comprising a second central opening and a second peripheral flange adapted to cover the hinge structure, the mask frame and the first peripheral flange of the inner door frame support, and the second window extending across the second central opening of the cover.

6. The door assembly of claim 5 wherein the inner door assembly further comprises a retainer removably secured in the other one of the horizontally disposed hinge seat portions, end the cover covering the retainer.

7. The door assembly of claim 6 wherein the first peripheral flange of the inner door support is ring shaped, the second peripheral flange of the cover is ring shaped, and the cover further comprises a rim depending rearwardly from the second peripheral flange and overlaying edge portions of the mask structure and the inner door frame support, and the depending rim having at least two horizontally disposed openings through one of which the hinge element extends from the door assembly.

8. The door assembly of claim 7 wherein the outer window is circular in shape and has a third peripheral flange fastened to the second peripheral flange of the cover.

9. The door assembly of claim 8 wherein the third peripheral flange of the outer window is an arcuate flange that is nested in the second peripheral flange and the rim, the third peripheral flange is substantially co-extensive with the second peripheral flange of the cover except where the second peripheral flange overlays the hinge structure.

10. The door assembly of claim 9 wherein the mask frame comprises a pair of opposing fourth peripheral flanges defining horizontally disposed cut out slots adjacent the horizontally disposed hinge seat portions, the fourth peripheral flanges each has a plurality of barb connectors extending rearwardly thereof, and the first peripheral flange of the inner door frame support has corresponding recesses adapted to receive and retain the barb connectors to thereby secure the mask frame with the inner door frame support.

11. The door assembly of claim 10 wherein the mask frame further comprises a recessed collar extending rearwardly from inner edges of the fourth peripheral flanges towards the window seat portion, and the collar having an inner surface and an outer surface, the outer surface comprising a plurality of rib spacers spaced about the collar and having tip portions adapted to secure the inner window in the recessed window seat portion.

12. The door assembly of claim 11 wherein the inner door assembly is secured to the outer door assembly by fasteners passing from the inner door frame support through aligned openings in the first peripheral flange of the inner door frame support, the fourth peripheral flanges of the mask frame, and the third peripheral flanges of the outer window and into aligned studs protruding from an inside surface of the second peripheral flange of the cover.

13. The door assembly of claim 12 wherein the aligned openings and studs are arranged in two patterns that are symmetrically disposed about a centerline extending horizontally across the door assembly.

14. The door assembly of claim 5 wherein the mask frame comprises a pair of opposing fourth peripheral flanges defining horizontally disposed cut out slots adjacent the horizontally disposed hinge seat portions, the fourth peripheral flanges each has a plurality of barb-like connectors extending rearwardly thereof, and the first peripheral flange of the inner door frame support has corresponding recesses adapted to receive and retain the barb connectors to thereby secure the mask frame with the inner door frame support.

15. The door assembly of claim 14 wherein the mask frame further comprises a recessed collar extending rearwardly from inner edges of the fourth peripheral flanges towards the window seat portion, and the collar having an inner surface and an outer surface, the outer surface comprising a plurality of rib spacers spaced about the collar and having tip portions adapted to secure the inner window in the window seat.

16. The door assembly of claim 5 wherein the inner door assembly is secured to the outer door assembly by a plurality of fasteners passing through aligned apertures in the inner door frame support, the mask frame, and the outer window, and into aligned studs protruding from an inside surface of the cover.

17. The door assembly of claim 5 wherein the outer cover comprises a handle secured to the outer window by fasteners passing through the outer window into studs in the handle.

18. The door assembly of claim 7 wherein the outer cover comprises a handle secured to the outer window by fasteners passing through the outer window into studs in the handle.

19. The door assembly of claim 13 wherein the outer cover comprises a handle secured to the outer window by fasteners passing through the outer window into studs in the handle.

20. The door assembly of claim 16 wherein the outer cover comprises a handle secured to the outer window by fasteners passing through the outer window into studs in the handle.

21. The door assembly of claim 6 wherein each of the hinge structure and the retainer is removably secured to the inner door frame support by at least one fastener extending therethrough and into the inner door frame support.

22. A method for reversibly mounting to a clothes dryer cabinet a door comprising an inner door assembly supporting an inner window and removably carrying a hinge, an outer door assembly supporting an outer window and removably attached to the inner door assembly, and removably carrying a retainer disposed 180 degrees from the hinge, the method comprising the steps of:

removing the door assembly at the hinge from the clothes dryer cabinet, removing the outer door assembly from the inner door assembly, removing the hinge from the inner door assembly and re-securing the hinge on the inner door assembly rotated 180 degrees from an initial hinge position, removing the retainer from the inner door assembly and re-securing the retainer on the inner door assembly rotated 180 degrees from an initial retainer position;

re-attaching the outer door assembly to the inner door assembly; and, re-attaching the door assembly at the hinge to the clothes dryer cabinet.

23. The method of claim 22 wherein the outer door assembly comprises a handle mounted to one side of the door, and the method further comprises, prior to the step of re-attaching the outer door assembly, the step of:

rotating the outer door assembly relative to the inner door assembly to rotate the handle to another side of the door.

24. The method of claim 23 wherein the outer door assembly is rotated 180 degrees relative to the inner door assembly.

* * * * *

UNITED STATES PATENT AND TRADEMARK OFFICE

CERTIFICATE OF CORRECTION

PATENT NO. : 7,614,162 B2
APPLICATION NO. : 11/431049
DATED : November 10, 2009
INVENTOR(S) : Pasquale Antonio Renzo It is certified that error appears in the above-identified patent and that said Letters Patent is hereby corrected as shown below:

Column 4, line 61, "62" should read --82--
Column 8, line 35, "end" should read --and--

Signed and Sealed this

Nineteenth Day of January, 2010

David J. Kappos

David J. Kappos
*Director of the United States Patent and Trademark Office*